United States Patent [19]

Ballarini et al.

[11] Patent Number: 4,545,867

[45] **Date of Patent: * Oct. 8, 1985**

[54] PROCESS FOR THE DIRECT ELECTRODEPOSITION OF GRAY CHROMIUM ON ALUMINUM BASE SUBSTRATES SUCH AS ALUMINUM BASE LITHOGRAPHIC SHEETS

[76] Inventors: John A. Ballarini, 1116 Virginia St., Racine, Wis. 53405; Timothy A. Hetland, 1916 Philips Ave., Racine, Wis. 53403

[ * ] Notice: The portion of the term of this patent subsequent to Feb. 1, 2000 has been disclaimed.

[21] Appl. No.: 542,095

[22] Filed: Oct. 18, 1983

Related U.S. Application Data

[63] Continuation of Ser. No. 253,223, Apr. 13, 1981, abandoned, which is a continuation-in-part of Ser. No. 34,179, Apr. 27, 1979, abandoned.

[51] Int. Cl.[4] ..... C25D 5/44

[52] U.S. Cl. ..... 204/33; 204/38.1; 430/276; 430/525

[58] Field of Search ..... 204/33.51, 34.32 R, 204/38.1, 38.7; 430/525, 526, 276, 278

[56] References Cited

U.S. PATENT DOCUMENTS

| | | | |
|---|---|---|---|
| 2,992,171 | 7/1961 | MacLean et al. | 204/51 |
| 3,493,474 | 2/1970 | Weber | 204/33 |
| 3,672,964 | 6/1972 | Bellis | 204/33 |
| 3,979,212 | 9/1976 | Peters et al. | 430/276 |

OTHER PUBLICATIONS

Metal Finishing Guidebook and Directory 1978, Metals and Plastics Publications, Inc. Hackensack, N.J., p. 156.

*Primary Examiner*—Andrew H. Metz
*Assistant Examiner*—William T. Leader

[57] ABSTRACT

Process for the direct electrodeposition of gray chromium of selectively constituted surface structure and grain texture on aluminum base substrates such as aluminum base lithographic sheet.

3 Claims, 31 Drawing Figures

Figure 1:
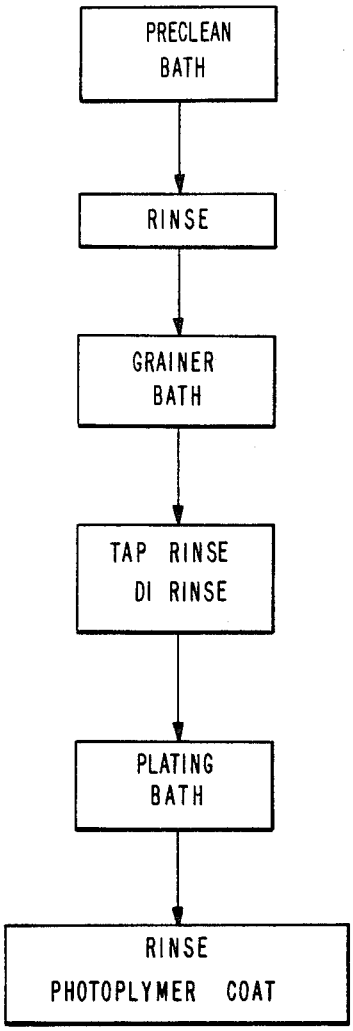

PROCESS FOR THE DIRECT ELECTRODEPOSITION OF GRAY CHROMIUM ON ALUMINUM BASE SUBSTRATES SUCH AS ALUMINUM BASE LITHOGRAPHIC SHEETS

This is a continuation of application Ser. No. 06/253,223 filed Apr. 13, 1981, now abandoned; which is a continuation-in-part of application Ser. No. 34,179 filed Apr. 27, 1979, now abandoned.

BACKGROUND OF INVENTION

This invention relates to the electrodeposition of gray chromium of selectively constituted crystalline character directly on aluminum base substrates and particularly to the fabrication of improved aluminum base lithographic sheet having fine secondary grained "gray" chromium directly plated thereon that can operatively function as an offset printing plate after exposure of an applied photo sensitive coating thereon.

This invention is a continuation in part of our earlier filed application Ser. No. 34,179 filed Apr. 27, 1979, now abandoned, and is particularly directed to the non-elected process subject matter disclosed and claimed therein.

Bi-metal and tri-metal lithographic plates have long been employed as an alternative to deep etch plates in the lithographic arts. As pointed out in "Chemistry of Lithography" by Hartsuch, published by the Graphic Arts Technical Foundation in 1961 (Lib of Cong. Cat. Card 60-13797) among the multimetal layered lithographic plates that have been commercially employed are the IPI tri-metal plate formed of a steel or zinc base sheet having an intermediate layer of plated copper and a surface layer of chromium plated over the copper; the "Lithure" plate formed initially of a copper sheet plated with a chromium and, more recently, of an aluminum base sheet having an intermediate layer of plated copper and a surface layer of chromium plated thereon; the "Aller" plate formed of a stainless steel base plate overlaid with plated copper; and the "Lithengrave" plate comprising a copper plated aluminum base sheet. For the purposes of convenience, both 1000 series aluminum sheet, such as 1100, and other aluminum alloy sheet used for lithographic plates, such as 3000 series sheet will be hereinafter termed generally as "aluminum" sheet or "aluminum base" sheet.

Although chromium has long been recognized as a preferred surface metal for lithographic sheet and aluminum has long been recognized as a convenient and relatively inexpensive basal sheet substrate therefor, the direct plating of gray chromium on aluminum base lithographic sheet on a commercially satisfactory basis has been a long sought but hitherto unattainable objective in the lithographic art. The patented art is replete with disclosures delineating the difficulties of directly plating chromium on aluminum or aluminum base substrates and the practical necessity of the incorporation of an intermediate coating therebetween. Whether such difficulties are attributable to the rapidity of oxide formation on aluminum surfaces or are attributable to a basic incompatability between the surface or plating adhesion characteristics of aluminum and chromium, the practical art, despite the brief appearance of chrome on aluminum lithogrpahic plates, has normally reverted back to the employment of an intermediate coating, most usually of another metal, such as Zinc, or flash coatings, such as copper, to effectively modify the aluminum base surface characteristics to permit gray chromium to be effectively plated thereon for lithographic usage.

This invention may be briefly and broadly described as an improved process for electrodepositing gray chromium of selectively constituted crystalline character and grain texture directly on aluminum base substrates. In its narrower aspects, the invention may be described as an improved process for fabricating aluminum base bi-metal lithographic plate having interfacially adherent directly plated gray chromium surface thereon of a fine secondary grain texture formed of progressively agglomerated spheroids. In a still further aspect, the invention includes the provision of an improved interfacial adherence between such electrodeposited chromium layer and an overlying coating of photo sensitive material.

Among the advantages of the subject invention is the provision of a process for the direct electrodeposition of gray chromium surface layers of fine secondary grained, closely adherent character, that are further characterized by a selectively constituted surface structure and grain texture, on base metal substrates such as aluminum. Other advantages include the provision of a chromium surfaced aluminum base lithograph plate that operatively functions, after exposure of an applied coating of photo sensitive material, as an offset printing plate; that is possessed of increased press life in terms of permitted impressions per plate, together with improved abrasion resistance, corrosion resistance and durability. Still further advantages of the subject invention are the provision of a chromium surfaced bi-metal lithographic plate that is markedly superior in photo sensitive coating adhesion, water carrying ability and printing fidelity. Additional advantages include increased efficiency of chromium plating and provision of a fine secondary grained and closely adherent directly plated chromium surface layer for lithographic plates that provide markedly improved press performance.

The primary object of this invention is the provision of an improved process of directly plating a gray chrome surface layer of markedly improved character on aluminum base lithograph sheet.

Another primary object of this invention is the provision of an improved process for obtaining gray chromium plated surfaces characterized by a selectively constituted surface structure and grain texture.

Other objects and advantages of the invention will become apparent from the following portions of this specification and from the appended drawings which illustrate, in accord with the mandate of the patent statutes, a presently preferred embodiment of the invention, and, in particular, the surface characteristics of the improved fine grained and closely adherent surface layer of plated chromium that results therefrom.

Figure 2C:
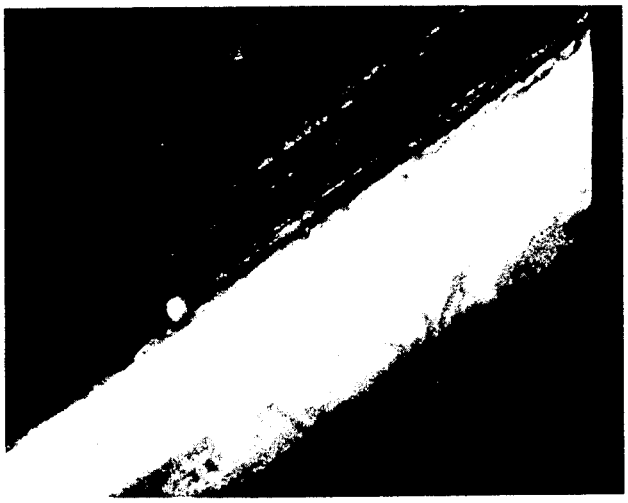
Figure 2B:
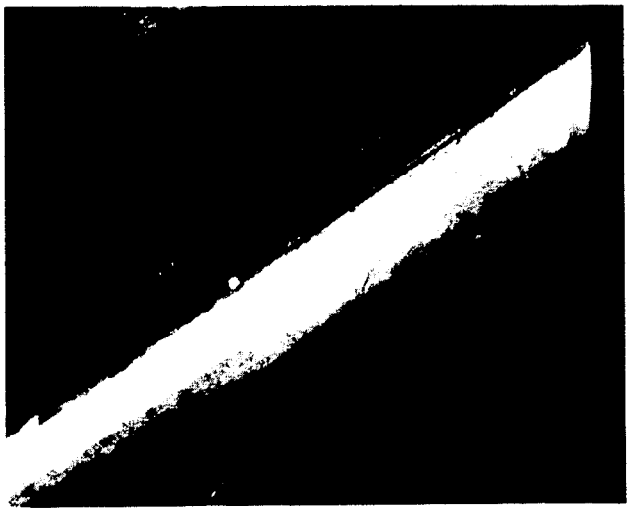
Figure 2A:
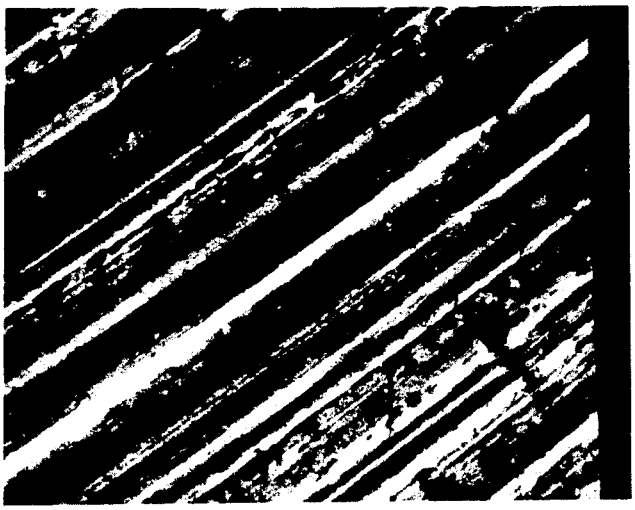
Figure 3C:
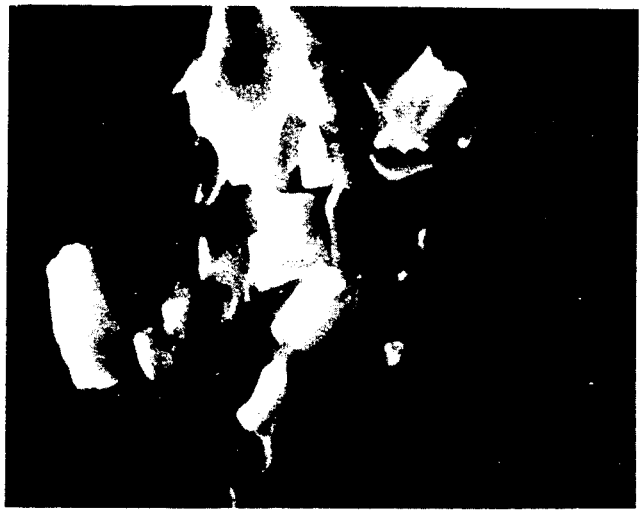
Figure 3B:
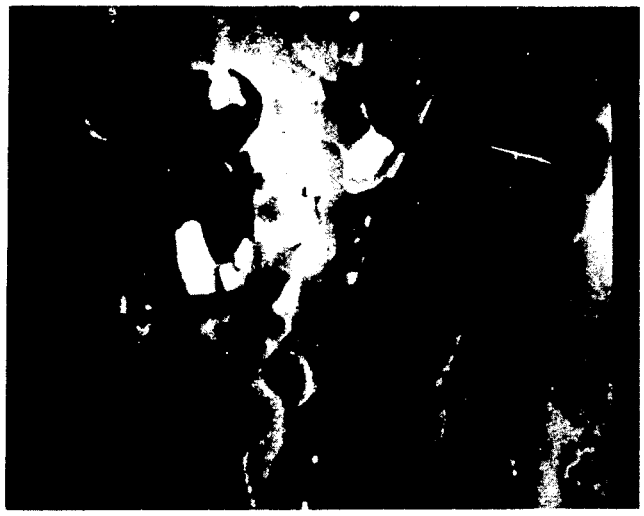
Figure 3A:
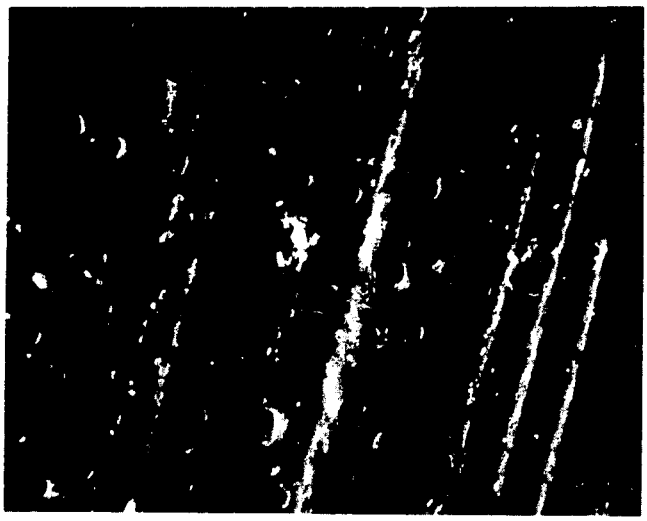
Figure 4C:
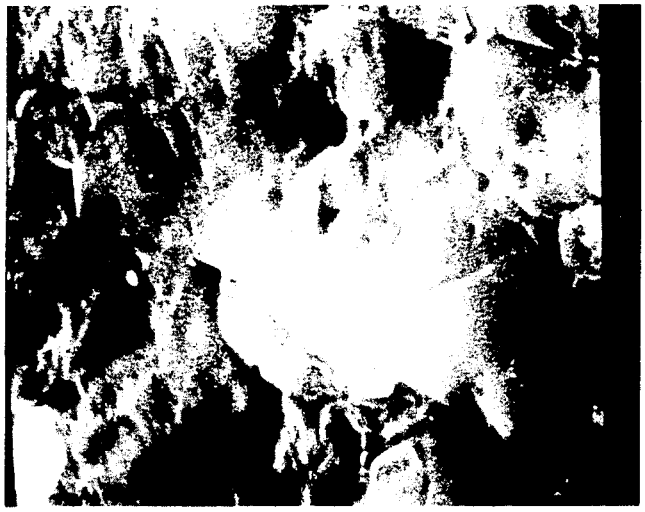
Figure 4B:
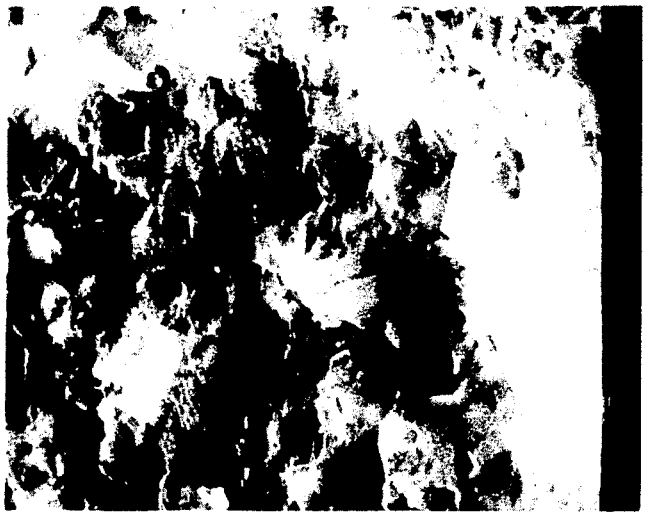
Figure 4A:
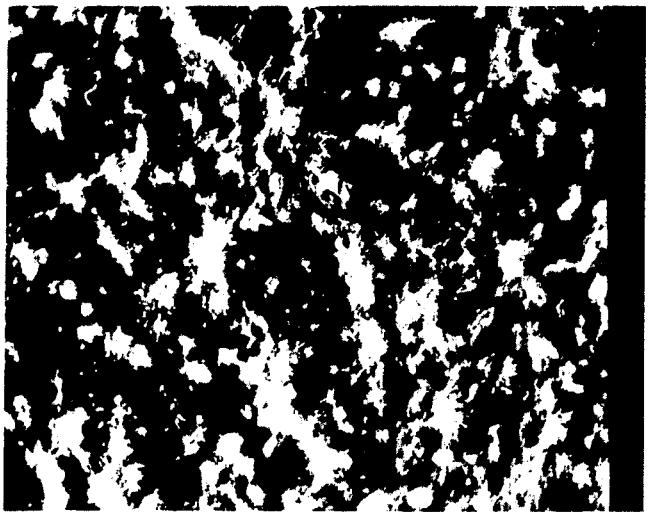
Figure 5C:
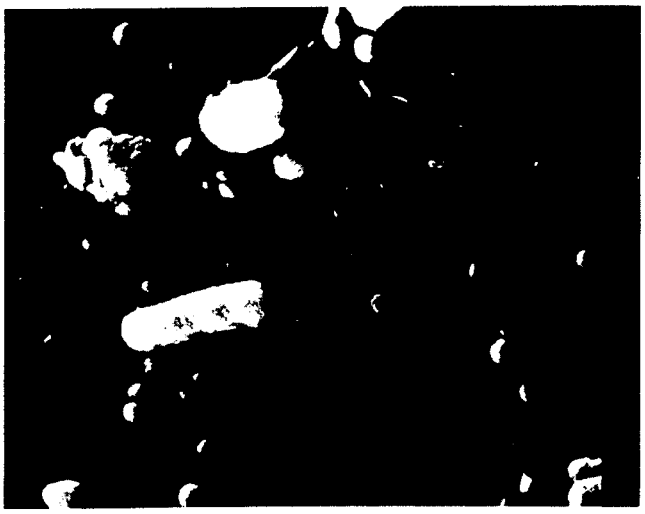
Figure 5B:
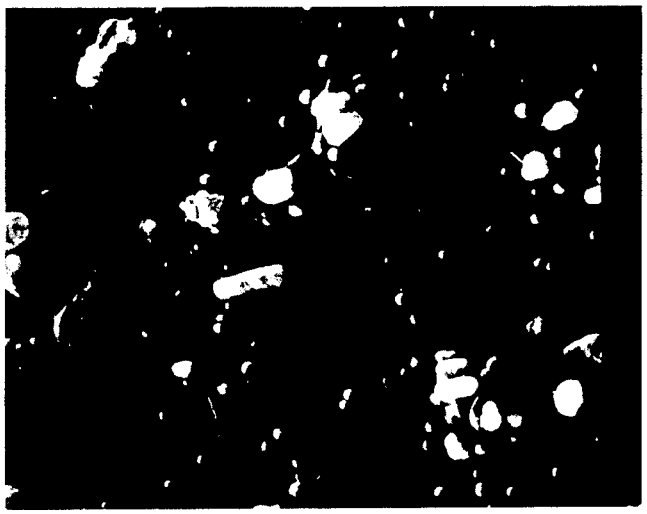
Figure 5A:
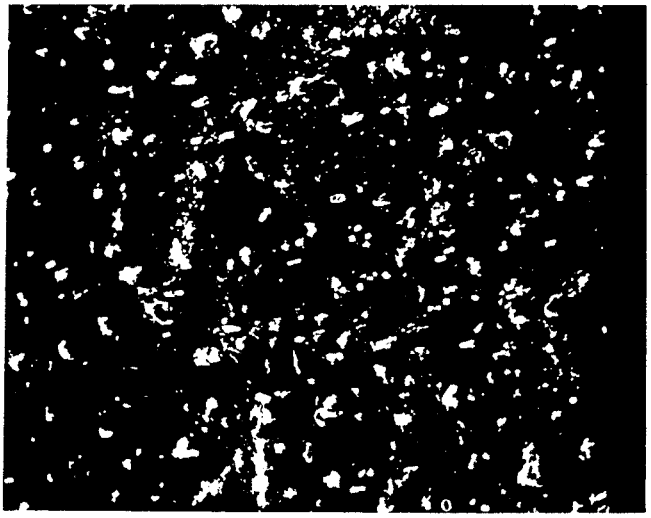
Figure 6C:
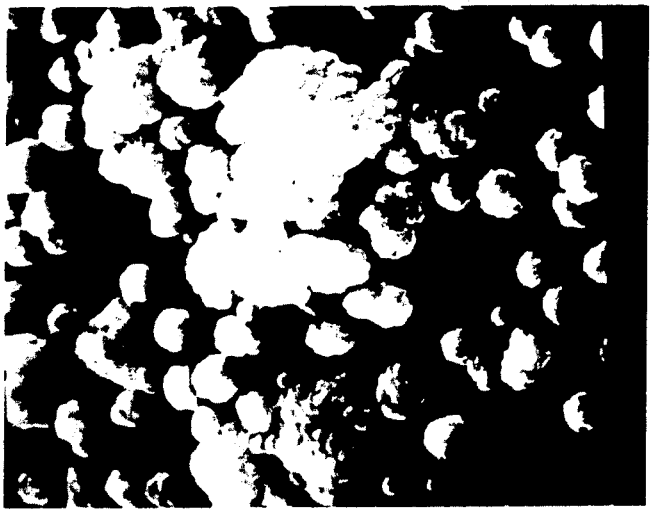
Figure 6B:
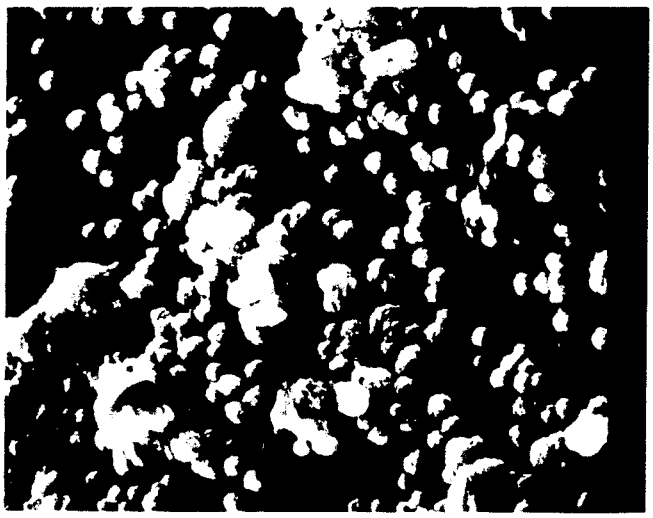
Figure 6A:
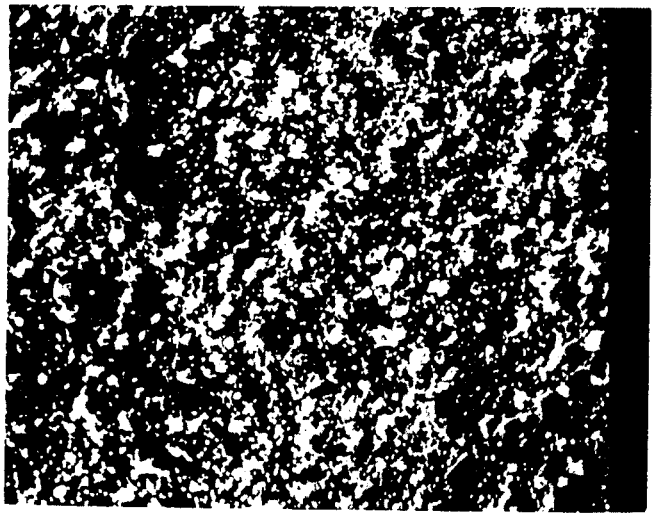
Figure 7C:
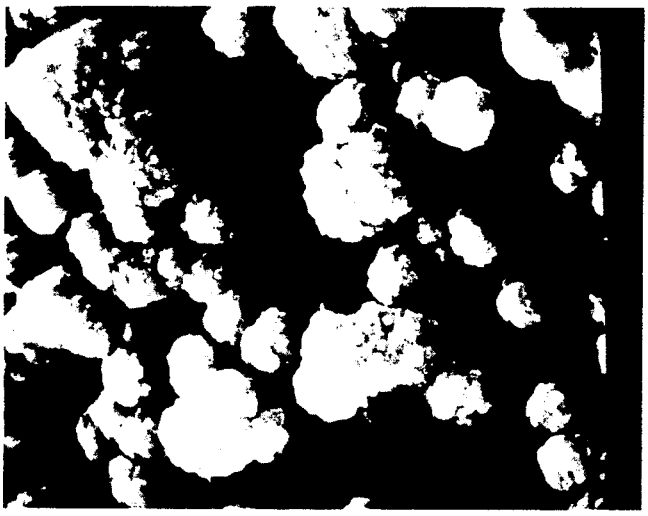
Figure 7B:
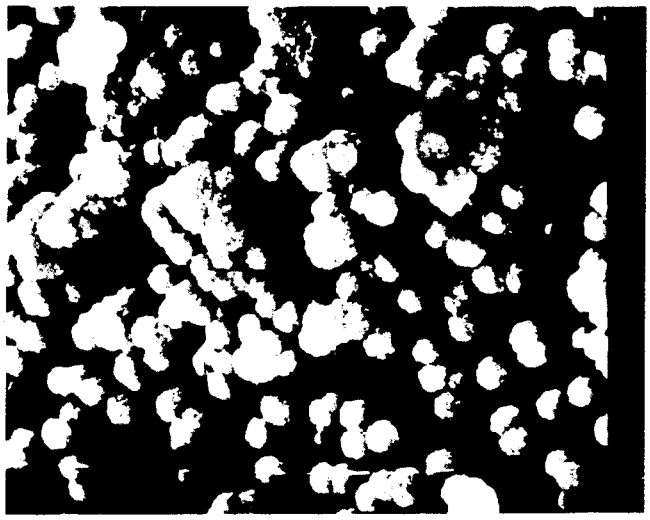
Figure 7A:
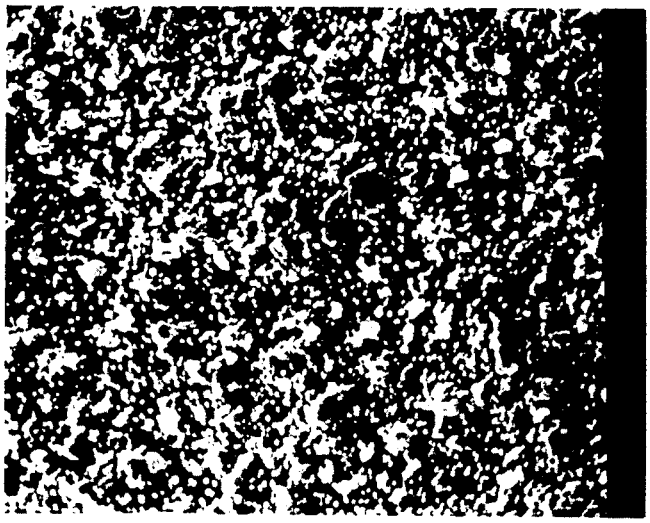
Figure 8C:
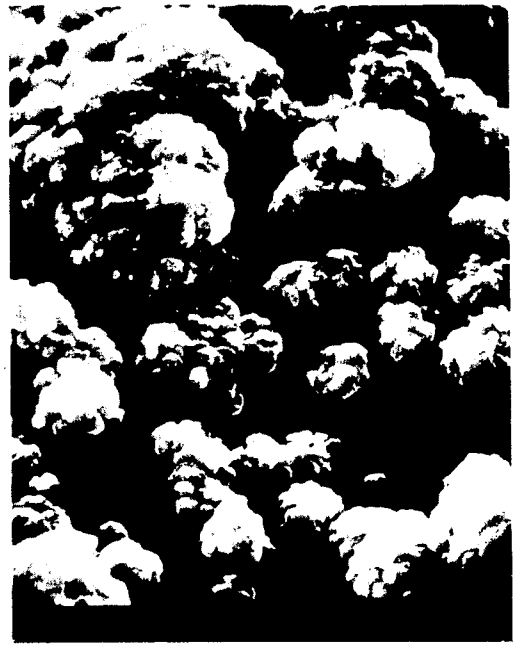
Figure 8B:
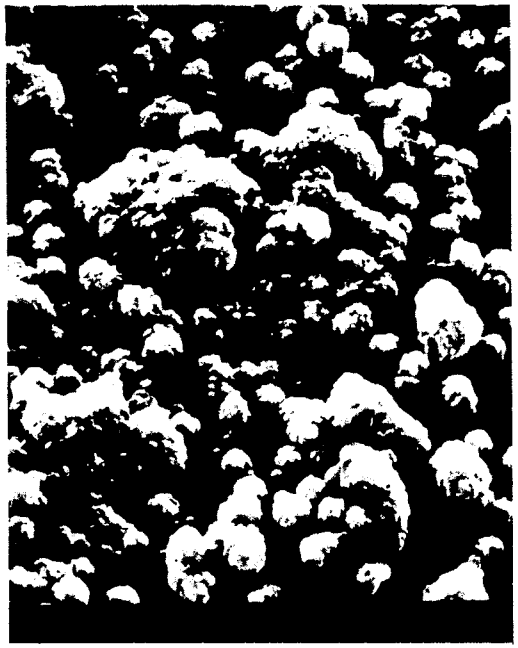
Figure 8A:
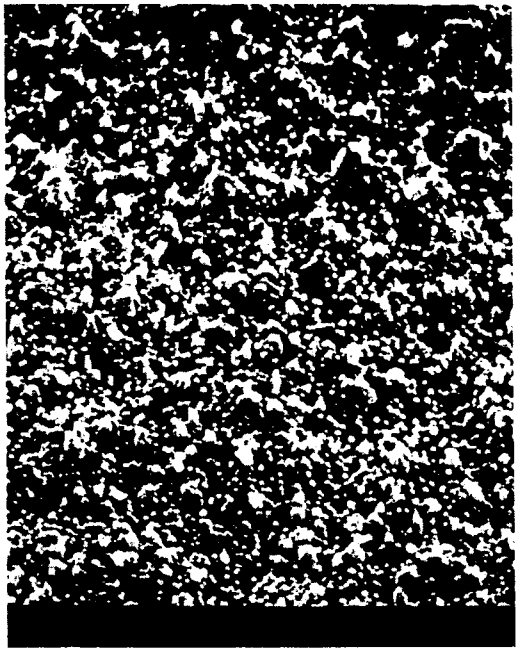
Figure 9C:
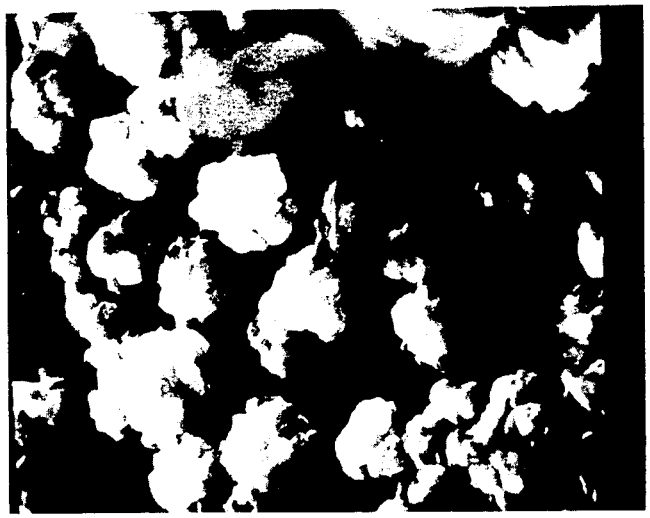
Figure 9B:
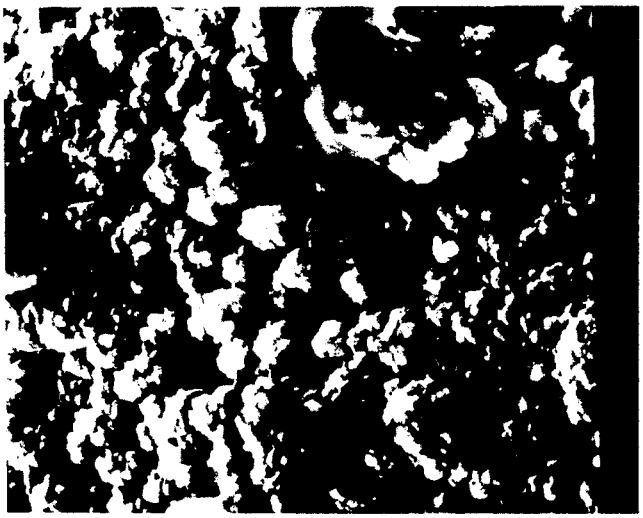
Figure 9A:
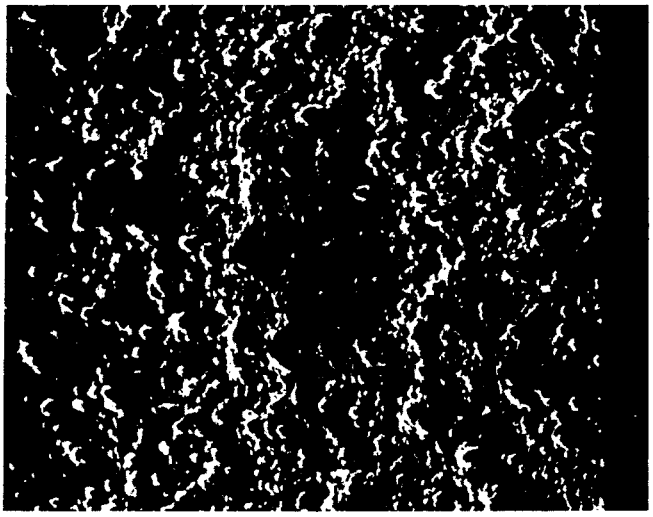
Figure 10C:
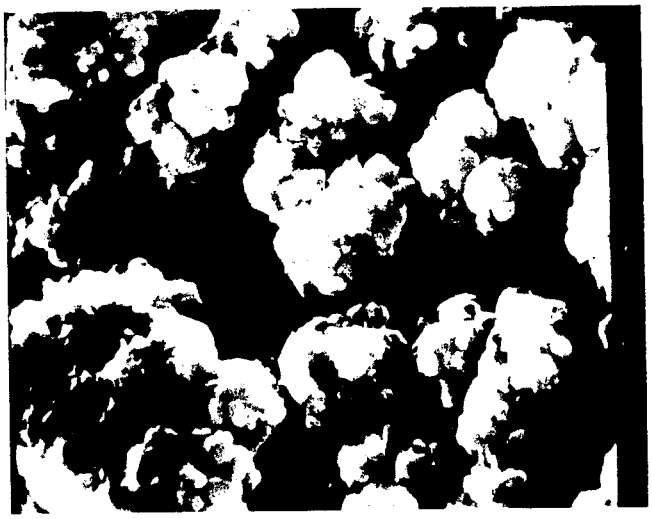
Figure 10B:
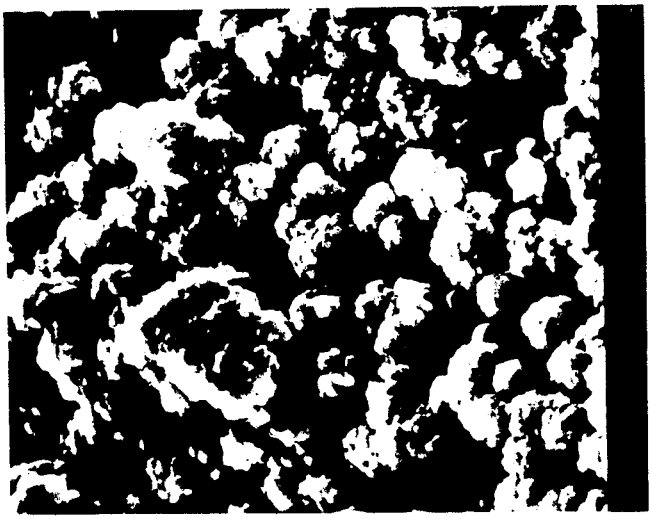
Figure 10A:
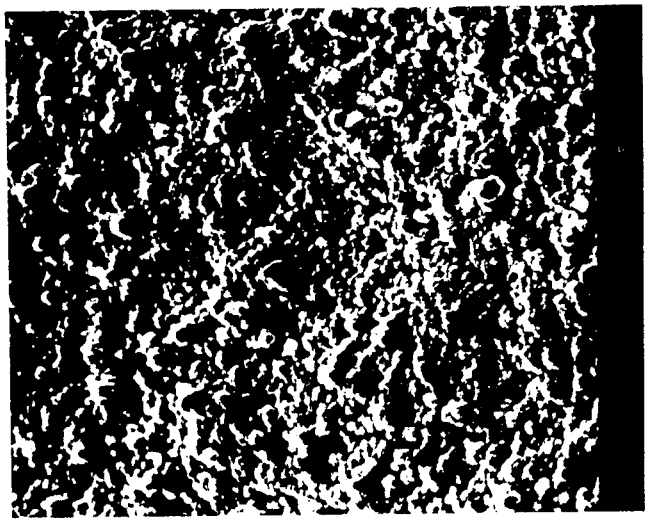
Figure 11C:
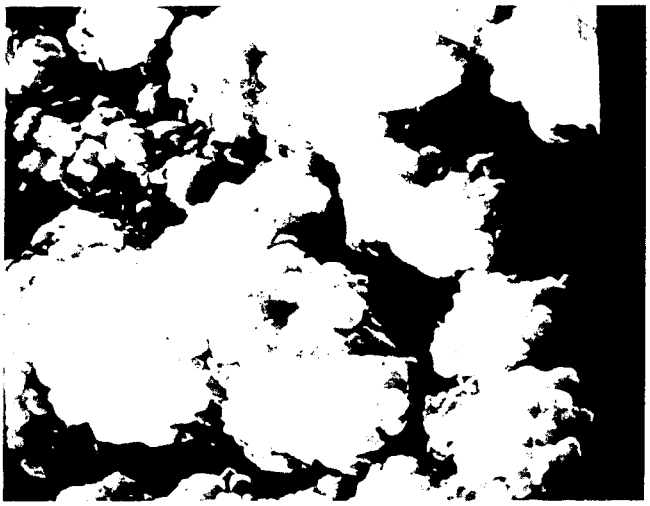
Figure 11B:
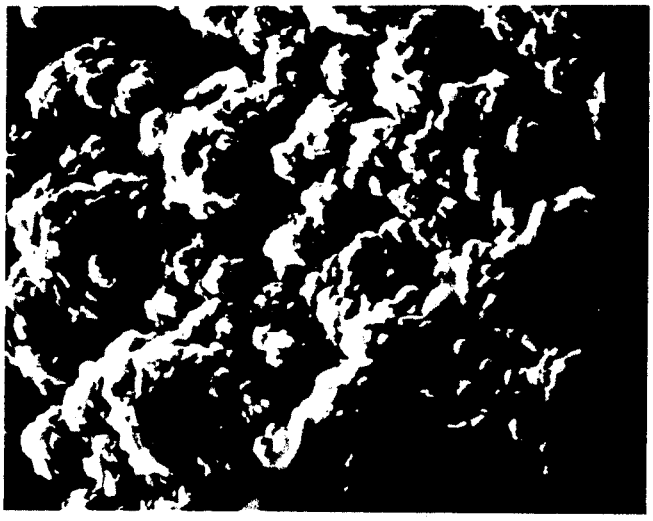
Figure 11A:
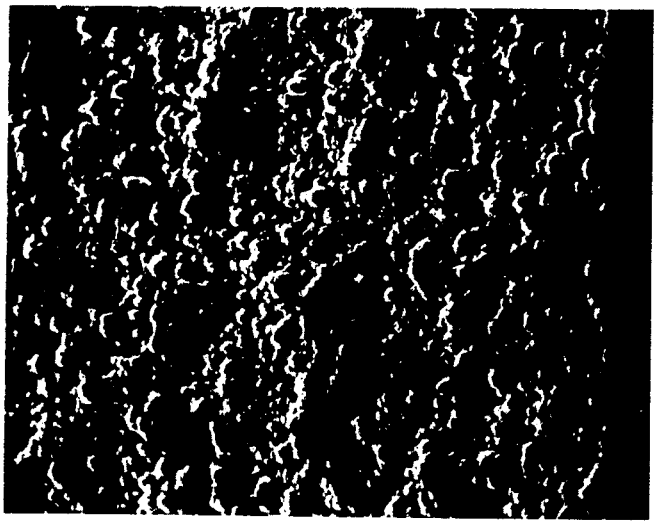

FIG. 1 is a schematic flow diagram of a sequence of fabrication steps that results in the provision of an improved chromium surface layer that is characteristic of the practice of this invention;

FIGS. 2*a* to 2*c* are representative scanning electron photomicrographs of the surface of an "as received" 1100 aluminum alloy sheet at magnifications of 1000×, 5000× and 10,000×;

FIGS. 3*a* to 3*c* are representative scanning electron photomicrographs of the 100 aluminum alloy sheet after 60 second immersion in a precleaning bath;

FIGS. 4*a* to 4*c* are representative scanning electron photomicrographs of the 1100 aluminum alloy sheet after immersion of the precleaned sheet in the selectively constituted grainer bath of this invention;

FIGS. 5*a* to 5*c* are representative scanning electron photomicrographs of the 1100 aluminum alloy sheet after immersion in the selectively constituted plating bath of this invention and exposure to current flow for 1 second;

FIGS. 6*a* to 6*c* are representative scanning electron photomicrographs of the 1100 aluminum alloy sheet after immersion in the selectively constituted plating bath of this invention and exposure to current flow for 5 seconds;

FIGS. 7*a* to 7*c* are representative scanning electron photomicrographs of the 1100 aluminum alloy sheet after immersion in the selectively constituted plating bath of this invention and exposure to current flow for 10 seconds;

FIGS. 8*a* to 8*c* are representative scanning electron photomicrographs of the 1100 aluminum alloy sheet after immersion in the selectively constituted plating bath of this invention and exposure to current flow for 15 seconds;

FIGS. 9*a* to 9*c* are representative scanning electron photomicrographs of the 1100 aluminum alloy sheet after immersion in the selectively constituted plating bath of this invention and exposure to current flow for 30 seconds;

FIGS. 10*a* to 10*c* are representative scanning electron photomicrographs of the 1100 aluminum alloy sheet after immersion in the selectively constituted plating bath of this invention and exposure to current flow for 45 seconds;

FIGS. 11*a* to 11*c* are representative scanning electron photomicrographs of the 1100 aluminum alloy sheet after immersion in the selectively constituted plating bath of this invention and exposure to current flow for 60 seconds.

As generally depicted in FIG. 1, an aluminum sheet suitably an 1100 aluminum alloy "litho" sheet in a gauge of about 0.008 to about 0.025, suitably 0.012 inch, is initially immersed in a precleaning bath 10 to remove rolling or other lubricants, grit, surface oxidants and other detritus from the metal surface. A suitable precleaning bath comprises about 2 to 8 ounces of etchant per gallon of water, for example, about 4 ounces per gallon, of conventional, commercially available etchant, suitably Liquid Etchant as manufactured by The Hydrite Chemical Company of Milwaukee, Wis. Such commercial etchant is believed to consist of about 50% sodium hydroxide and a chelating agent, sodium glucoheptanate, in water. A presently preferred precleaning solution comprises 55 ounces of liquid etchant and 9.6 gallons of water. (A 10 gallon solution.)

Such precleaning bath apparently offers a wide tolerance range with respect to temperature, concentration and to the presence of impurities. For example, a satisfactory ultimate product was obtained and no readily observable variation in the final plated chromium surface structure, grain texture and uniformity of coverage was noted where the temperature of the precleaning bath varied between 90° F. to 190° F., or where the immersion time of such 1100 aluminum alloy "litho" sheet varied from 5 to 120 seconds or where the solution concentration varied from 2 ounces to 8 ounces of liquid etchant per gallon of precleaner solution. Preliminary testing has also indicated that the character of the plated product does not change appreciably with respect to either surface structure, grain texture or plating thickness where common contaminants such as 1 oz./gallon of mineral oil; $AlK(SO_4)_2$; $Fe(NO_3)_3$; sodium silicate; grainer solution or chromer solution was added to the precleaning bath 10.

Immediately after removal of the aluminum base metal substrate from the precleaning bath 10 and without permitting the sheet surface to dry, the cleaned substrate is subjected to a thorough rinse 12, as by a strong multidirectional spray of 60°-70° F. water for 15 to 45 seconds. If the precleaned sheet is not properly rinsed, nonuniform plating may ultimately result.

Again without permitting the precleaned and rinsed sheet to dry, the cleaned and rinsed sheet is promptly immersed in a grainer bath 14. In contrast to the apparent lack of criticality of the preclean bath 10, the composition, temperature, impurity level and immersion time in the grainer bath 14 are all attended with some degree of criticality. Such grainer bath 14 preferably comprises a bifluoride solution such as ammonium bifluoride ($NH_4HF_2$) or sodium bifluoride ($NaHF_2$) in water. A presently preferred grainer solution is ammonium bifluoride ($NH_4HF_2$) in water.

Satisfactory operation has been achieved and an acceptable final product obtained with respect to the plated chromium surface structure, grain texture and plating thickness, where grainer bath temperatures were maintained between 80° and 160° F.; the concentration of ammonium bifluoride was varied between 4.0 to 16.0 ounces per gallon and the immersion time varied between 10 to 120 seconds. In contradistinction to the foregoing however, the characteristics of the final plated product with respect to surface structure and grain texture deteriorated significantly when immersion in the grainer bath 14 was omitted entirely or where the bath temperature was reduced to 70° F. or where the immersion time was reduced to about 5 seconds. Such ultimate product deterioration was also noted when common contaminants, such as ferric or aluminum cations, were present in the grainer bath 14 at relatively low concentrations.

A presently preferred set of operating parameters for grainer bath 14 immersion of 1100 alloy, include a grainer solution strength of 8 ounces of ammonium bifluoride per gallon of water, a bath temperature of 120° F. and an immersion time of 60 seconds. A presently preferred set of operating parameters for 3003 alloy, include a grainer solution of 7 ounces of ammonium bifluoride per gallon of water, a bath temperature of 105°-110° F. and an immersion time of 60 seconds.

Following removal of the sheet from the grainer bath 14, the aluminum substrate is again immediately subjected to a strong multidirectional spray rinse 16 of 60°-70° F. water for 15 to 45 seconds and then to a strong multidirectional spray rinse 18 of 50° to 70° F. deionized water. Here again, if the substrate or sheet is not properly and thoroughly rinsed, nonuniform plating may result.

Again without permitting the rinsed sheet to dry, the chemically grained substrate is immersed in a selectively constituted electroplating bath 20 and connected as the cathode in a plating circuit in which conventional 0.93Pb/0.07 Sn plating anodes are employed.

A preferred plating bath composition is made up of 34 ounces of chromic oxide and 0.27 ounces of sulfuric acid per gallon of deionized water. In the production of a chromium plating thickness of 45 to 55 microinches from such bath of 34 oz. $Cr^{+6}$ and 0.27 oz. $SO_4^{-2}$ per gallon satisfactory results, insofar as the improved surface structure and secondary grain texture are concerned, have been obtained at the following current densities (less than 5% ripple) and exposure times in a 95° F. bath.

| | ANODE TO CATHODE AREA RATIO |
|---|---|
| 500 Amp/ft$^2$ | 60 sec. (An/Ca of 1.26) |
| 700 Amp/ft$^2$ | 35 sec. (An/Ca of 1.06) |
| 900 Amp/ft$^2$ | 35 sec. (An/Ca of 0.91) |

In its broad aspects, the plating bath 20 should be so constituted as to maintain a $Cr^{+6}/SO_4^{-2}$ ratio range of from about 75 to 180, plating currents of from about 300 to 1000 amperes/sq. ft. and plating times of about 30 to 60 seconds should be used. Satisfactory results with respect to the gray chromium surface structure, grain texture and plating thickness have been obtained by operations within the above parameters and where the bath temperature has been maintained between 70° and 100° F. and preferably between 80° and 95° F.

Information available to date indicates that presence of contaminants in the plating bath 20 deleteriously affects both the character of the plated surface structure, the secondary grain texture and the thickness of the chromium plate. For example, the presence of ferric or aluminum cations, as would result from the presence of ferric or aluminum salts at concentrations of about 1.0 oz./gal., caused a deterioration in both chromium surface character and secondary grain texture, as well as a decrease in plated chromium thickness by 30–50%. The presence of ferric ammonium sulfate, zinc sulfate, and aluminum ammonium sulfate at concentrations of 1.0 oz./gal. had no apparent effect on the plated chromium crystal structure, but resulted in decrease in the plated chromium thickness of 5 to 10%. Also noted was that hydrofluoric acid added as a second catalyst removed all primary grain and decreased the plated chromium thickness by 6% at 0.1 oz./gal., 54% at 0.5 oz./gal. and 75% at 1.0 oz./gal.

The directly chromium plated aluminum base metal substrate resulting from the foregoing process steps is then rinsed in the manner heretofore described and, after drying, is ready to be coated with a commercially available photo sensitive coating by conventional processes.

As mentioned earlier, the directly electrodeposited gray chromium layer that results from the practice of the above described process appears to be possessed of singular surface structure and secondary grain texture. FIGS. 2*a–c* through 11*a–c* pictorially delineate the progressive formation and ultimate character of the improved chromium plated deposit under scanning electron photomicrographs at magnifications of 1000×, 5000× and 10,000× respectively. As will be apparent to those skilled in this art, such scanning electron photomicrographs depict only a very small area of the total sheet surface. It is extremely difficult, if not a practical impossibility, to rephotograph the exact same area in a series of exposures. Therefore, the depictions in the series of photomicrographs included in this application are representative of the progressively formed surface character but are not repetitive photographs of exactly the same area.

FIGS. 2*a* to 2*c* illustrate the surface characteristics of a typical "as received" surface of 0.012 inch thick 1100 aluminum alloy "litho" sheet having on the surface thereof residual oils, grit, surface oxide and other detrius.

FIGS. 3*a* to 3*c* illustrate the surface of 1100 aluminum alloy "litho" sheet (taken from same coil) after 60 second immersion in the above described precleaning bath 10 which cleans and partially etches the sheet surface.

FIGS. 4*a* to 4*c* illustrate the surface of the precleaned 1100 aluminum alloy "litho" sheet (taken from the same general area of the same coil) after 60 second immersion in the above described bifluoride grainer bath 14. The chemical modification of the "litho" sheet surface to form a roughened and random mountain peak pit and valley surface texture is clearly apparent. Such surface texture is believed to differ appreciably from the surface textures that result from mechanical or electrochemical graining techniques.

FIGS. 5*a* to 5*c* illustrate the surface of the grained litho sheet after 1 second exposure to current flow in the plating bath. Notable is the presence of widely separated and extremely small sized particles of electroplated chromium, most of which are spheroidal in character. It appears from a comparison of FIGS. 4*b* and 5*b*, that the particles of chromium, at least at the initiation of deposition, are much smaller in size than the pits and depressions in the selectively grained receiving surface of the metal substrate and are readily containable therewithin.

FIGS. 6*a* to 6*c* illustrate the surface of such 1100 alumiuum alloy "litho" sheet after 5 seconds exposure to current flow in the selectively constituted plating bath 20. As is apparent, the chromium is now apparently being deposited in the form of small, composite and generally spheroidal particles, each of which is now apparently being constituted by multiplicites of the even smaller seed particles of spheroidate character as shown in FIGS. 5*a* to 5*c*. Such particles appear to be, at this early stage of plating, of individually discrete character although instances of apparent coalescive growth is taking place. As best shown in FIG. 6*c* (under 1000× magnification) the deposited chromium particles are of generally spheroidal character, present a generally lobate curvilinear external contour and are characterized by a marked absence of planar exterior surfaces and relatively sharp protuberant angles. A comparison of FIGS. 6*b* and 6*c* indicate that the deposited particles of chromium appear to be compositely constituted of agglomerated or otherwise autogeneously bonded pluralities of smaller sized particles of markedly smaller dimension but of generally spheroidate character. Because of such composite constitution, the exterior surfaces of the particles, while still curvilinear in overall shape, are of generally lobular and bullate character and, as coalescive agglomeration proceeds, present marked localized departures from true spheroidal character and hence the term "lobular" will be herein utilized to describe the general character of the resultant deposit.

FIGS. 7*a* to 7*c* show the progressive formation of the electrodeposited chromium layer after 10 seconds exposure to the plating current within the bath 20. As shown, the particles appear to be growing in diameter. While, still appearing to be generally spheroidal in character, the growth is apparently being effected by the continued deposition of extremely small spheroids on the exposed surfaces thereof. Continuous formation of both new individual and composite agglomerated spheroids is apparently continuing to take place, with the gradual formation (see FIG. 7*a*) of a more continuous, insofar as exposed unplated areas of the basal substrate are concerned, deposited surface. Coalescive agglomeration of spheroids of progressively increasing diameter is apparently continuing to take place. (See FIG. 7c.)

FIGS. 8a to 8c show the progressive formation of the electrodeposited chromium layer after 15 seconds exposure to current flow in the plating bath 20. As is apparent, the mechanics of deposition is apparently continuing by the progressive buildup of composite spheroidates of progressively increasing size with an accompanying increasing degree of coalescive buildup of the larger size agglomerates. It also appears, however, that the individual and progressively agglomerated particles continue to present a generally lobular curvilenear contour and are characterized by a marked absence of planar exterior surfaces and relatively sharp protuberant angles.

FIGS. 9a to 9c show the continued progressive formation of the electrodeposited chromium layer after 30 seconds exposure to current flow in the plating bath 20. The basic mechanics of deposition, as described above, are apparently continuing in a similar manner with a continued progressive buildup of spheroidates of increasing size from smaller size spheroidates and with an increasing degree of coalescive buildup of larger size agglomerates. Such buildup, due to the inherent spherical growth pattern and interengagement of the larger sized agglomerates, is starting to be characterized (see FIG. 9b) by the apparent presence of voids and tortuous passages within the composite layer. It is equally apparent, however, that the individual and progressively agglomerated spheroidate particles continue to present a generally lobular curvilinear contour and are characterized by a marked absence of planar exterior surfaces and relatively sharp protuberant angles. Likewise, the electrodeposited chromium layer, while being compositely constituted of agglomerated or otherwise joined pluralities of smaller sized particles of widely varying dimensions but of generally spheroidate or lobate character, is now of such overall continuity (see FIG. 9a) as to effectively present an almost continuous layer of chromium on the substrate surface.

FIGS. 10a to 10c show the further progressive buildup of the electrodeposited chromium layer and as the same was constituted after 45 seconds exposure to current flow in the plating bath 20. FIG. 10 *a* shows the fine secondary three dimensional grain texture that is continuously being formed. FIGS. 10b and 10c clearly depict the continued formation of spheroids of progressively increased dimension through coalescive agglomeration with a departure from the spheroid growth pattern for the larger sized agglomerates with the consequent apparent formation of voids and tortuous passages in the nature of a capillary type labyrinth throughout the deposited layer. Such fine secondary grain texture and apparent labyrinth type structures are believed to cooperate to present marked increases in available exposed surface area, both in the layer surface and interstices therebeneath.

FIGS. 11a to 11c further depict the progressive formation of the electrodeposited chromium layer after 60 seconds exposure to current in the plating bath 20. Such further exposure has resulted in the continued coalescive agglomeration of spheroids of progressively increasing dimension with an apparent continued deposit of small sized spheroidate chromium particles on the exposed surfaces thereof. As here shown, a satisfactory depth of plating has been obtained. Further depth of plating thickness is generally not required.

The resultant finished structure, as shown in FIGS. 11a to 11c, has a fine secondary grained surface of microscopically rough character. As pointed out above, the electrodeposited gray chromium layer appears to be compositely formed of myriads of progressively agglomerated spheroids that coalescively agglomerate to form exposed or otherwise accessible surface areas of markedly increased extent and which is made up of particles of generally curvilinear contour in the nature of rounded lobes or lobules, which impart an apparent bullate and/or modular composite surface configuration. Such particle shape and buildup results in a fine secondary grain texture which, apart from presenting markedly increased exposed and available surface areas, also appears to provide a subterranean labyrinth structure of capillary dimension for reception, retention and increased adherence of photo sensitive material or the like.

As will now also be apparent to those skilled in this art, the lobular or spheroidate particles that compositely form the deposited chrome layer in accord with the principles of this invention are sized somewhere between ultramicroscopic and superatomic rather than microscopic (100×) in dimension. While not fully understood at the present time, it is believed that the chemically grained surface and/or the mechanics of the initial and continuing deposition of chromium particles operate in some way to overcome the recognized electroplating incompatability of chromium on aluminum. Whether such markedly improved adhesion and cohesion between the electrodeposited chromium and the surface of the aluminum base substrate is due to chemical interreaction or physical interrelationships or to a combination of both is not presently known but the improved resultant adhesion between the electrodeposited gray chromium and the aluminum surface is readily apparent.

In complement to the above, the much finer nature of the deposited chromium particles and the grain texture apparently resulting from the singular and coalescively agglomerated spheroid shape thereof results in a highly anisotropic and discontinuous exposed surface and an apparent labyrinthine undersurface structure of capillary dimension. Such distinctive surface and undersurface configuration provides for a high degree of photo sensitive coating or photo resist adhesion and permitted usage of the resulting product as an offset plate.

Preliminary information has indicated that lithographic plates formed in accordance with the principles of this invention have markedly extended the permitted running life of aluminum base plates up to 600,000 or 1,000,000 or even more impressions due to increased wear resistance of the exposed chrome surfaces and increased adhesion of the exposed photo sensitive coatings thereon.

Having thus described our invention we claim:

1. In the direct electrodeposition of gray chromium on the surface of an aluminum base substrate, the steps of immersing a precleaned aluminum base substrate for at least 10 seconds in a grainer bath consisting of about 4 to 16 ounces of a bifluoride selected from the group consisting of ammonium bifluoride or sodium bifluoride per gallon of water maintained at a temperature in the range of about 80° to 160° F., immediately rinsing said aluminum base substrate with water to remove grainer bath solution therefrom, immersing said rinsed and grained aluminum base substrate without intermediate drying thereof in an electroplating bath selectively consituted of water, chromic oxide and sulfuric acid in amounts to maintain a $Cr^{+6}/SO_4^{-2}$ ratio in the range of about 75 to 180, exposing said immersed metal substrate in said plating bath to a plating current in the range of 300 to 1000 amperes per square foot for at least 30 seconds, and maintaining said plating bath at a temperature in the range of about 70° to 100° F. while plating current flows therein.

2. The method as set forth in claim 1 including the step of coating said electrodeposited chromium surface with a photo sensitive material.

3. The method as set forth in claim 1 wherein said grainer bath consists of about 7 to 8 ounces of bifluoride per gallon of water.

* * * * *